United States Patent [19]

Waibel

[11] Patent Number: 4,498,794

[45] Date of Patent: Feb. 12, 1985

[54] PRINTER FEEDER

[75] Inventor: Helmut K. Waibel, Fremont, Calif.

[73] Assignee: Durango Systems, Inc., San Jose, Calif.

[21] Appl. No.: 612,366

[22] Filed: May 21, 1984

[51] Int. Cl.[3] ..... B41J 13/10

[52] U.S. Cl. ..... 400/629; 400/636.2

[58] Field of Search ..... 400/629, 624, 625, 636.2, 400/633.2; 271/114, 116, 127, 160, 171, 4

[56] References Cited

U.S. PATENT DOCUMENTS

| | | | |
|---|---|---|---|
| 1,104,504 | 7/1914 | Holliday | 400/629 |
| 1,203,657 | 11/1916 | Sheckler | 400/629 |
| 1,417,597 | 5/1922 | Gallien | 400/629 |
| 1,919,238 | 7/1933 | McCarthy | 271/119 |
| 2,227,643 | 1/1941 | Hageman | 400/629 |
| 4,131,274 | 12/1978 | Sue | 271/127 X |

*Primary Examiner*—Edgar S. Burr
*Assistant Examiner*—Charles A. Pearson
*Attorney, Agent, or Firm*—Thomas E. Schatzel

[57] ABSTRACT

A self-feeding feeder for use with printers having rotatably driven friction feed rollers. The feeder includes mounting plates conforming to the shape of the printer print station for removably mounting the feeder. A gear is attached to the friction feed rollers and supplies rotary motion to a pair of drive rollers via an intermediate drive train. A pair of spring loaded guides having integral sides formed therein urge individual cut sheets of media out of an input media support tray and into the printer. The drive mechanism includes a pin and key drive assembly to maintain media spacing. Deflector means and an output tray are provided which automatically collect and collate the sheets of media emerging from the printer.

12 Claims, 7 Drawing Figures

PRINTER FEEDER

BACKGROUND OF THE INVENTION

1. Field of the Invention

The present invention relates to printer paper feeders, and more particularly to an automatic paper feeder for printers utilizing rotatably driven input friction feed rollers.

2. Description of the Prior Art

U.S. Pat. No. 4,417,825 issued to Cushman et al. discloses an improved print medium drive for line/series printers having two modes of operation. A first mode for advancing continuous web print medium, and a second mode for advancing individual cut sheets of print medium. The latter has many applications which cannot be handled by the former, for example prestige level correspondence. When the printer is used in the individual cut sheet mode, the sheets must be fed into the printer individually. This slows printing of these cut sheets and requires continual operator attention.

Automatic paper feeder devices for printers are known in the art, however these tend to be relatively complicated requiring special mounting and/or driving connections.

SUMMARY OF THE PRESENT INVENTION

Accordingly, it is an object of the present invention to provide a printer feeder for use with a print medium driving mechanism having a mode adapted for driving individual cut sheets of print medium.

It is another object of the present invention to provide an automatic paper feeder which may be easily installed onto and removed from a printer, without requiring a latching mechanism.

Another object of the present invention is to provide an automatic paper feeder which is inexpensive and simple to manufacture and simple to operate.

It is another object of the present invention to provide a paper feeder which is relatively free from print sheet jams.

It is another object of the present invention to provide a paper feeder which does not require an output driver.

It is another object of the present invention to provide a paper feeder which maintains a preselected spacing between individual cut sheets of print medium, even after reverse feeding.

Briefly, in a preferred embodiment, the present invention is a paper feeder for removably fitting about a print medium feeding mechanism of a printer having a pair of friction feed rollers for frictionally engaging individual cut sheets of print medium. The feeder includes a pair of mirror image vertically mounted side plates between which are affixed a paper input support and a main paper deflector having a curved lower surface. The side plates each include tapered mounting guides adapted for fitting about a paper feeding mechanism of a printer and between the housing surfaces thereof. The side plate mounting guides further include a slot for loosely fitting over a driveshaft of the printer and a notch for locking onto a guide bar of the printer. A pair of mirror image paper guide plates are affixed to a pivot rod and pivot therewith. The input paper support is formed in an "L" shape and extends slightly below the paper guide plates. A compression spring is interposed between the input paper support and each paper guide plate, so as to urge the paper guide plates forward over the lip of the input paper support. Rotatably mounted slightly above the input paper support is a first drive shaft and pair of drive rollers. The drive shaft and rollers are driven by an intermediate gear train mounted about the left side plate of the feeder. A second drive shaft and a first drive gear are rotatably mounted between the side plates and within the main deflector. Mounted on the left side of the second drive shaft and engaged with the gear train is a second drive gear. The printer, with which the feeder device is adapted for use, includes a pair of input friction feed rollers mounted about a square drive shaft. Each friction feed roller has mounted on its inside surface a friction feed gear. The feeder is placed about the printer drive shaft and positioned such that the first drive gear engages the friction feed gear. Rotary motion is thus supplied to the drive rollers from the friction feed gear via the first and second drive gears and the intermediate gear train.

Pivotably mounted about the outside portions of each paper guide is a paper stripper which extends underneath the paper guide and includes a flat portion coplanar with the lower lip of the paper tray and a triangular projection extending vertically above the lower end of the paper guide. A keeper bar extends across the width of the feeder just above the first drive shaft, and fits into an L-shaped slot formed into each side plate. The keeper bar simplifies loading paper into the paper tray by securing the paper guide plates out of the way of the drive rollers.

The main deflector includes a curved lower surface and an upper deflector for directing paper as it comes out of the printer. A paper output tray is provided which rests on the printer cover and locks under a pair of steps on the feeder.

An advantage of the present invention is that it is simple and economical to manufacture, and simple to operate.

Another advantage of the present invention is that it is easily installed onto and removed from a printer, and requires no latching devices or separate power connections.

Another advantage of the present invention is that it is strictly mechanically operated and requires no electrical power source.

It is another advantage of the present invention that the paper guides have integral sides to reduce frictional contact of the paper with the paper guide during movement of the paper guides as the paper is pushed into the drive rollers.

Another advantage of the present invention is that it is jam resistant.

Another advantage of the present invention is that a preselected paper spacing is maintained, even if the printer operator reverse feeds.

These and other objects and advantages of the present invention will no doubt become obvious to those of ordinary skill in the art after having read the following detailed description of the preferred embodiment as illustrated in the various drawing figures.

IN THE DRAWING

DETAILED DESCRIPTION OF THE PREFERRED EMBODIMENT

Figure 1:
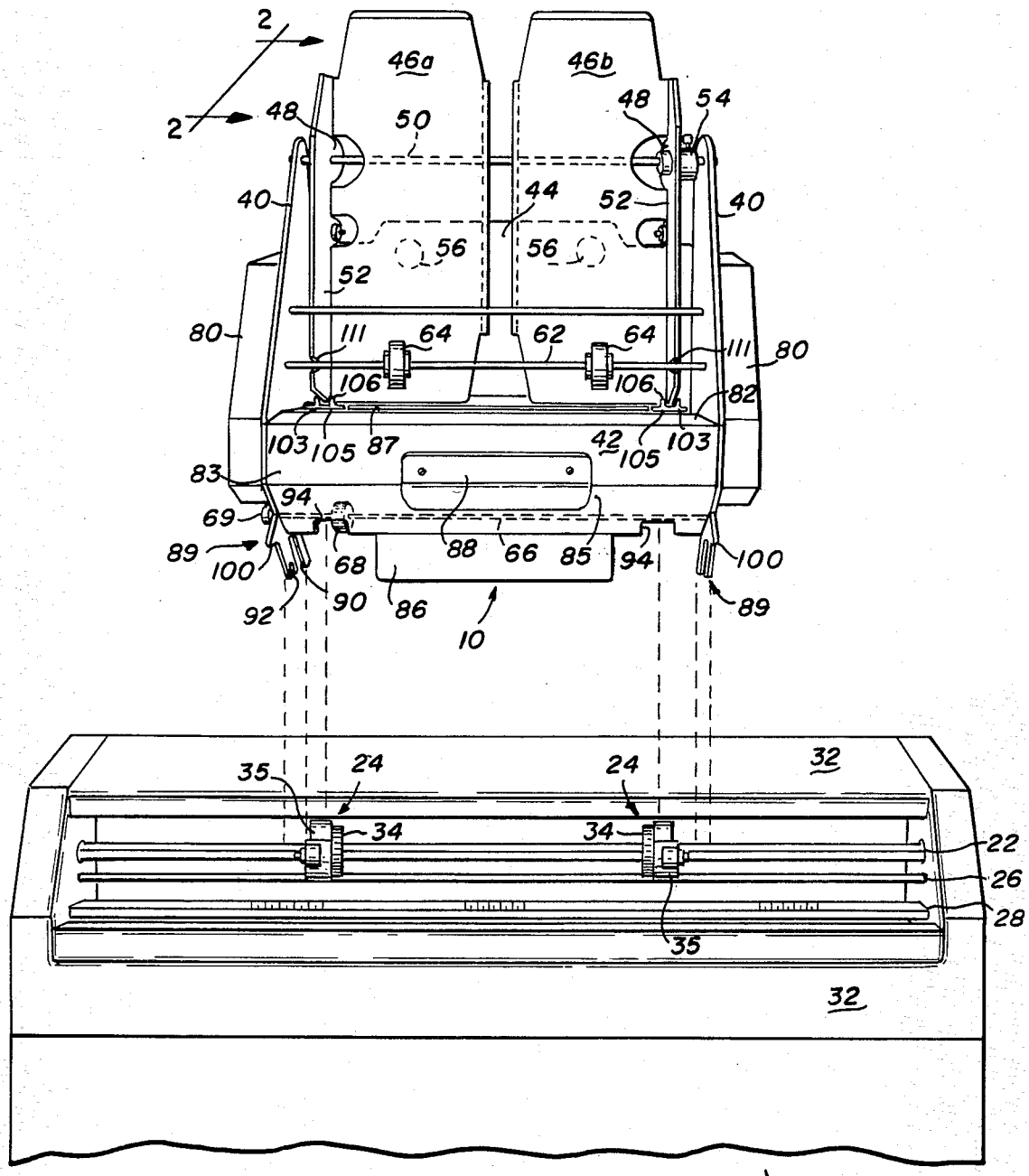
FIG. 1 is a frontal perspective view of the printer feeder of the present invention and positioned above a printer for mounting thereon.

FIG. 1 illustrates the paper feeder of the present invention and referred to by the general reference numeral 10. The paper feeder 10 is shown above a printer 20 with which it is adapted for engaging. The printer 20 includes a square drive shaft 22 about which is secured a pair of friction feed roller assemblies 24. The drive shaft 22, friction feed roller assemblies 24 and printer 20, in general, are disclosed in U.S. Pat. No. 4,417,825 issued to Cushman et al. and assigned to the same assignee as the present invention and incorporated herein by reference. The operation of the drive shaft 22, friction feed roller assemblies 24 and the lower friction feed roller (not shown) are fully described therein. The printer 20 further includes a guide rod 26 and an index bar 28. The printer 20 is generally enclosed by a rigid plastic or metal housing 32.

Attached to each friction feed roller assembly 24, about the inside surfaces thereof, is a friction feed gear 34 which is coaxial with the friction feed roller assemblies 24 about the square drive shaft 22. The friction feed gears 34 are slightly smaller in diameter than the friction feed rollers 24 to ensure unimpaired functioning of a driving surface 35 thereof. The friction feed gears 34 are formed of a plastic material and are unitary with the friction feed rollers 24.

Figure 2A:
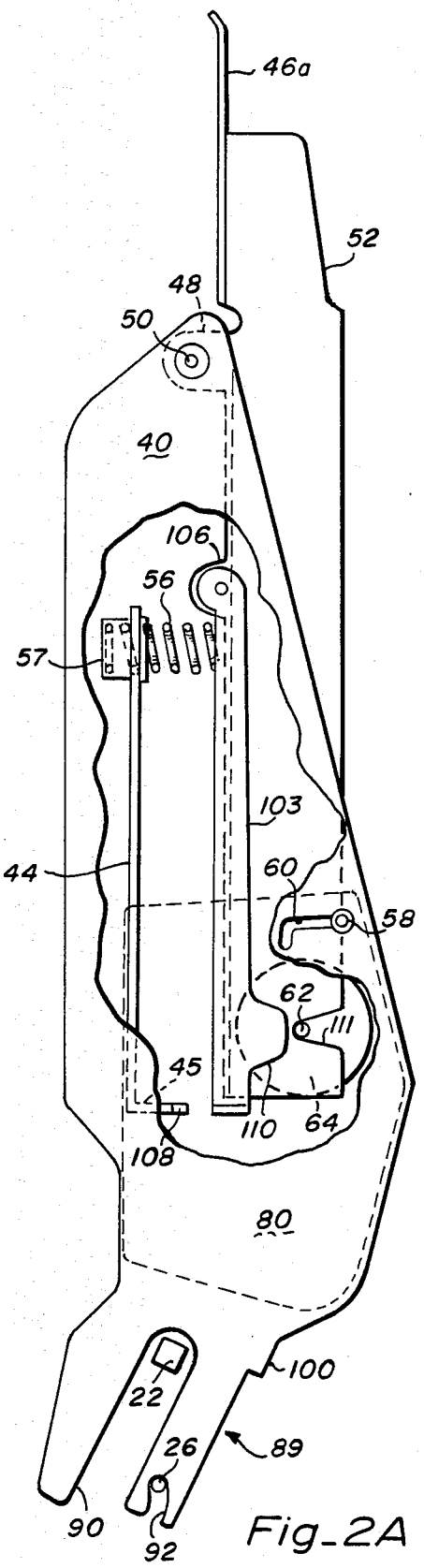
FIG. 2A is a side, partially cut-away view, taken along line 2—2 of FIG. 1, showing the paper guide plates in the forward position.
Figure 2B:
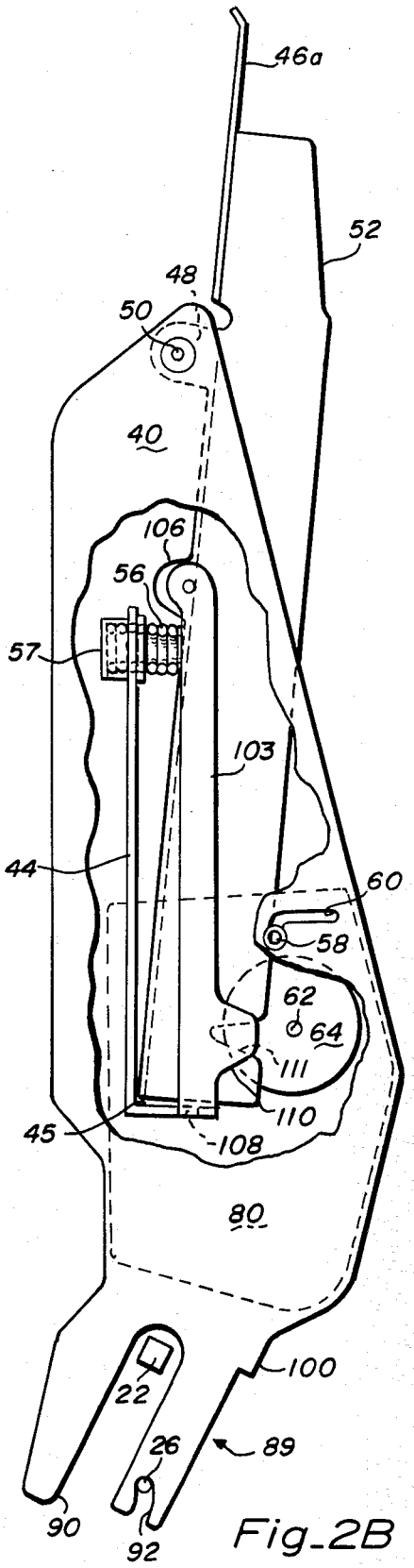
FIG. 2B is a side partially cut-away view, taken along line 2—2 of FIG. 1, showing the paper guide plates in the back position.
Figure 2C:
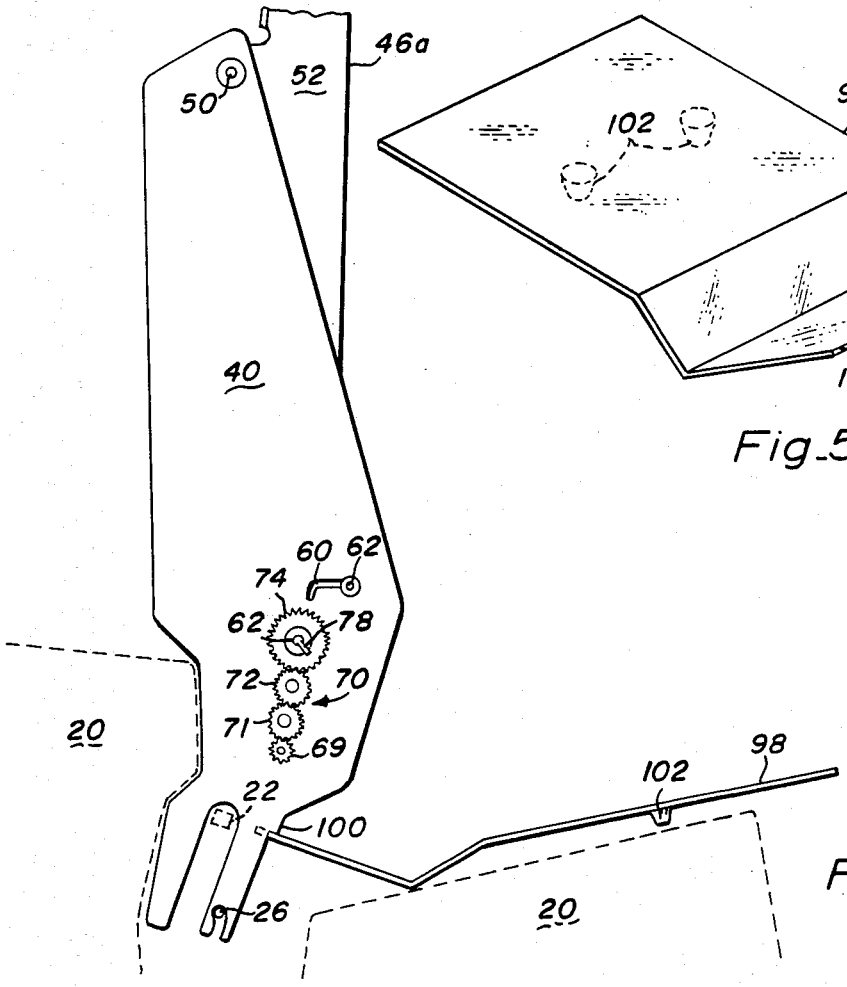
FIG. 2C is a side view with the cover removed, taken along line 2—2 of FIG. 1 showing the gear train and the paper output tray in place.

The paper feeder 10 slidably fits over the friction feed roller assemblies 24 of the printer 20 and is powered by the printer drive shaft 22 via the friction feed gears 34. The paper feeder 10 includes a pair of mirror image side plates 40 illustrated in FIGS. 2A–2C which are secured to opposite lateral ends of a main deflector 42. The side plates 40 may additionally be secured by a tie rod (not shown) extending therebetween. Also secured to and between the side plates 40 is an input paper support 44, illustrated also in FIG. 3. The input paper support 44 is L-shaped, having a lower projecting lip 45 as shown in FIGS. 2A–2C and extends the full width of the feeder 10. Pivotably mounted between the side plates 40 and partially resting within the input paper support 44 is a pair of mirror image paper guides 46*a* and 46*b*. The paper guides 46*a* and 46*b* are flat, generally rectangular plates and include flanges 48 formed on each back side surface for inserting a pivot bar 50 therethrough. The paper guides 46*a* and 46*b* further include at each outside edge an integral side flange 52 extending forward from the paper guides 46*a* and 46*b*. Both flanges 48 and 52 extend perpendicularly to the plane of the paper guides 46*a* and 46*b*. The pivot bar 50 extends between each side plate 40 near the top portions thereof and through apertures in the flanges 48. A lock nut assembly 54 is secured to the flange 48 of the paper guide 46*b* and over the pivot bar 50. This lock nut assembly 54 allows for lateral positioning of the paper guide 46*b* on the shaft 50 to accommodate varying paper sizes. For example, customarily used European letter size paper is approximately one-quarter of an inch narrower than that customarily used in the United States, and can be accommodated thereby. If lateral adjustability is not desired, the paper guides 46*a* and 46*b* may be a single unitary piece, and the lock nut assembly 54 omitted.

As shown in FIGS. 2A–2C and 3, each paper guide 46*a* and 46*b* is biased outwardly, away from the input paper support 44 by means of a pair of springs 56, interposed between the paper support 44 and each paper guide 46*a* and 46*b*. Each spring 56 rests in a cup 57, affixed to the input paper support 44. It may be noted that while spring tension in the feeder 10 is fixed, it may be adjusted by simply moving the spring 56 or cup 57 relative to the paper guides 46*a* and 46*b*. For example, the lip of the cup may be shimmed to bring it closer to the paper guide, thus increasing spring tension.

The paper guides 46*a* and 46*b* are thus urged forward away from the input paper tray 44 about the pivot bar 50. The forward position is the operational position for feeding paper into a printer, and the backward position is employed to load sheets of paper into the feeder 10. These positions are illustrated by FIGS. 2A and 2B, respectively. To simplify loading, a keeper rod 58 extends across the width of the feeder 10, parallel to the pivot bar 50, and fits into an L-shaped slot 60 formed into each side plate 40. When the keeper rod 58 is pushed back, it contacts the flanges 52 of the paper guides 46*a* and 46*b* and urges the paper guides 46*a* and 46*b* back with it. When the keeper bar 58 is pushed into the lower lip of the L-shaped slot 60 the paper guides 46*a* and 46*b* are locked in their rearmost position (See FIG. 2B). When the keeper rod 58 is freed from the lower lip of the L-shaped slots 60, the paper guides 46*a* and 46*b* are allowed to come fully forward (See FIG. 2A) to ensure that all paper carried thereon is fed into the printer 20.

Just below and parallel to the keeper bar 58 is a first drive shaft 62, rotatably mounted between the side plates 40. Affixed to and coaxial with the first drive shaft is a pair of drive rollers 64. Each drive roller 64 is laterally aligned about a midpoint of the width of each paper guide 46*a* and 46*b*. The drive roller 64 associated with the paper guide 46*b* may be slightly off center towards the paper guide 46*a*, to accommodate both customary sized American and European letter paper.

Figure 3:
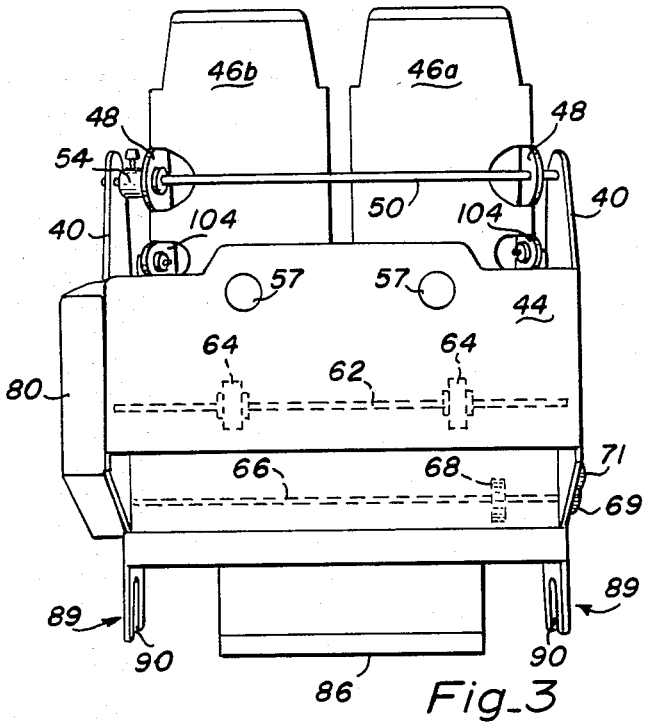
FIG. 3 is a back perspective view of the printer feeder of FIG. 1.
Figure 4:
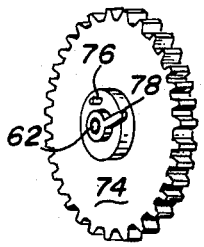
FIG. 4 is a close up perspective view of the drive roller gear.

The first drive shaft 62 and hence drive rollers 64 are rotatably driven by the friction feed gear 34. Located near the bottom of the main deflector 42, rotatably mounted and parallel with the pressure bail 62 is a second drive shaft 66. A first drive gear 68 is secured to the second drive shaft 66 near a left side thereof. The drive gear 68 is aligned to mesh with the friction feed gear 34 of the printer 20. A second drive gear 69, illustrated in FIGS. 2C and 3 is affixed to the end of and coaxial with the second drive shaft 66, and rests against the left side plate 40. Gears 68 and 69 are of the same diameter and teeth number. Mounted on the side plate 40 and engaged with the second drive gear 69 is a gear train 70, comprising a first idler gear 71, a second idler gear 72 and a roller drive gear 74. The gears 68, 69, 71, 72 and 74 may be fabricated of any suitably rigid strong material. For example, in the feeder 10 they are made of nylon. Rotation is supplied to the first drive shaft 62 from the roller drive gear 74 through a pin 76 and key 78, illustrated in FIG. 4. The pin 76 is a circular projection secured to, and perpendicular with the plane of the roller drive gear 74, and rotates therewith around the axis of the first drive shaft 62. A first end of the drive shaft 62 extends through the side plate 40 on which the gear train 70 is mounted and is formed with a D-shaped cross-section. The key 78 includes a similarly D-shaped central aperture to snugly lock onto the first drive shaft 62. As the roller drive gear 74 rotates, the pin 76 contacts the key 78, thus transmitting the rotary motion of the gear 74 to the first drive shaft 62 and drive rollers 64. The pin 76 occupies only about twenty degrees of arc of the circular gear 74. Over the remaining approximate three hundred and forty degrees of travel, the pin 76 does not contact the key 78, thus no motion is supplied to the first drive shaft 62. This feature serves to automatically regulate the feed spacing between individual sheets of paper during feeding. Other methods, for example a one-way clutch, may also be utilized of transferring motion from the roller drive gear 74 to the first drive shaft 62. In the feeder 10 the pin 76 is fabricated as a unitary molded piece with the roller drive gear 74. The gear train 70 is enclosed by a cover 80 which is secured to the side plate 40 and is generally congruent in dimensions therewith. A cover 80 is also placed about the right side plate 40 for symmetry of appearance.

Referring again to FIG. 1, a main deflector 42 includes a generally flat, horizontally oriented upper surface 82, a pair of generally flat, vertically oriented front surfaces 83, a curved lower surface 85, deflector 42 is positioned so that a slot 87 exists between the back extension 86 and the paper guides 46*a* and 46*b* when in their forward position. Paper is driven-by the drive rollers 64 through the slot 87 into the printer 20. When the paper emerges from the printer 20 it will be directed upwards by the action of the printer friction feed rollers 24. The curved lower surface 85 of the deflector 42 is designed to deflect the paper horizontally outward from the feeder 10. The angle of the deflector surface 85 in the feeder 10 is about thirty-five degrees, although this angle is not critical. Deflection and proper outfeed of the paper is aided by an upper deflector 88 which is an angled bracket, attached to the front deflector surface 83 and angled slightly downwardly from the vertical.

Each side plate 40 terminates in its lower end in a tapered mounting guide 89, which includes a slot 90 and a mounting notch 92 formed therein, as illustrated in FIGS. 2A–2C. The large slot 90 is adapted for clearing the square drive shaft 22 of the printer 20. The mounting notch 92 locks the feeder 10 to the guide rod 26 of the printer 20. The feeder 10 thus rests on the printer 20, with the tapered mounting guides 89 in contact with the guide rod 26 and the covers 80 resting atop the printer housing 32. As illustrated in FIG. 1, the deflector assembly 42 includes in the lower curved surface 85 a pair of steps 94. These steps 94 are spaced to fit over the friction feed roller assemblies 35 when the feeder is placed about the printer 20. The first drive gear 68 extends slightly into the left step 94 so that it may contact the friction feed gear 34. The curved, tapered rear extension 86 of the main deflector 42 extends downward, and slightly backwards, and terminates at a point just below the lower ends of the tapered mounting guides 89. A printer of the type described in Cushman et al., having the capability of advancing both individual cut sheets or a continuous web of print medium, includes a paper tensioner (not shown) within the printer to supply tension to a continuous web of print medium. When the feeder 10 is utilized with such a printer, the rear extension 86 is adapted to contact and cam back the paper tensioner to ensure smooth infeeding of the individual sheets.

Figure 5:
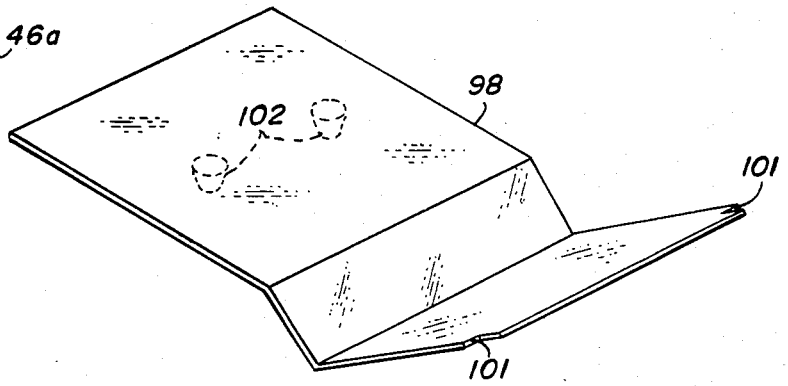
FIG. 5 is a perspective view of the output paper tray.

As illustrated in FIGS. 2C and 5, an output paper tray 98 is provided which may be inserted under a pair of steps 100 formed into the front portions of the tapered mounting guides 89 of the side plates 40. The output paper tray 98 is formed of any suitable lightweight material and in the apparatus 10 is plastic. The tray 98 includes a notch 101 at each lateral end thereof for engaging the steps 100 and simply rests on top of the printer 20, shown in phantom in FIG. 2C aided by a pair of feet 102 attached to the underside of the tray 98.

Pivotably attached to the paper guides 46*a* and 46*b* are a pair of paper strippers 103. These are generally L-shaped, as illustrated in FIGS. 1, 2A and 2B and extend downward on the outside of, and to a point just below each paper guide 46*a* and 46*b*. The strippers 103 are pivotably mounted at a flange 104 on the side of each paper guide 46*a* and 46*b* and extend downward to a point which is coplanar with the lip 45 of the paper tray 44. At this point, the strippers 103 bend ninty degrees inwards to form a flat surface 105 which is about half of an inch long. Projecting vertically upward from the flat surface 105 about the front side thereof is a triangular flag 106. At each side of the L-shaped lip 45 of the input paper support 44, there is formed a step 108. These steps 108 are illustrated in FIGS. 2A and 2B and allow the flat surfaces 105 of the paper strippers 103 to rest against the lip 45 when the paper guides 46*a* and 46*b* are in the retracted position. The strippers 103 further include flanges 110 which are formed to be coplanar with a V-shaped first drive shaft cutout 111 formed into each side flange 52 of the paper guides 46*a* and 46*b*.

The feeder 10 may be formed of any strong, rigid, lightweight material and in the preferred embodiment is formed generally of steel, with the covers 80 formed of plastic. Various parts may be nickle plated for durability and in the feeder 10 the paper guides 46*a* and 46*b* are so plated. Any suitable, low friction material, such as plastic may be used as bearings to reduce frictional engagement of the drive shafts with their metal supports. The feeder 10 is designed to hold approximatly one hundred and eighty sheets of twenty pound paper, which may be standard or legal length. The feeder 10 is about five inches high, twelve inches wide and fourteen inches long, but it may be constructed in any configuration to suit the desired paper size.

Operation of the feeder 10 is as follows. The feeder 10 is placed about a printer 20, with the slots 90 of the tapered mounting guides 89 clearing the drive shaft 22, and the notches 92 secured to the guide rod 26. The drive gear 68 is meshed with the friction feed gear 34. The output paper tray 98 is inserted under the steps 100 of the side plates 40, and rests atop the printer 20. The keeper bar 58 is manually pushed back, locking the paper trays 46*a* and 46*b* for loading. Paper is loaded into the feeder 10. The paper tray 46*b* may be adjusted, using the lock nut assembly 54, to the desired width. The keeper bar 58 is released, allowing the springs 56 to urge the paper guides 46*a* and 46*b* into contact with the drive rollers 64. When the printer 20 begins its paper feed sequence, rotary motion is supplied to the roller drive gear 74 from the friction feed gear 34 through the gear train 70. When the pin 76 hits the key 78, the drive rollers will begin driving a sheet of paper out of the paper trays 46*a* and 46*b*, through the paper strippers 103, and slot 87 and into the printer 20. Until picked up by the printer friction feed rollers 24 the paper is driven solely by the drive rollers 64. The friction feed rollers 24 drive the paper at a slightly faster rate than the drive rollers 64. When the paper engages the friction feed rollers 24, the key 78 will rotate slightly ahead of the pin 76 and will no longer be driven thereby. The pin 76 continues to circle, however, driven by the gear train 70. When the paper becomes fully disengaged from the pressure rollers 64 the key 78 stops. This automatically spaces the next sheet as no motion will be supplied to it until the pin 76 again catches up to the key 76. For an eleven inch sheet, this results in a spacing gap of about two inches. Note that the pin 76 and key 78 allow an operator to maintain this spacing even after reverse feeding the sheet. Because the pin 76 must contact the key 78, the spacing will be maintained following reverse feeding since the drive rollers 64 will not be driven until the pin 76 again contacts the key 78. This feature allows for reverse feeding at least two or more lines without interrupting the spacing sequence.

Upon emerging from the printer 20 the sheet of paper contacts the lower curved deflector surface 85 and the upper deflector 88 and falls partially into the output paper tray 98. The trailing edge of the sheet is still within the main deflector 42 however. The leading edge of the next sheet to emerge from the printer 20 will contact the trailing edge of the former sheet and bump it fully out onto the output paper tray 98. The process is repeated by each succeeding sheet until the output is completed. Each sheet emerging from the printer falls face down onto the output paper tray, and on top of the preceeding sheet. The papers are thus automatically collated as they emerge.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A self-feeding feeder for use with a printer having a driven feed roller disposed about a drive shaft for frictionally engaging and advancing individual cut sheets of print media, comprising a friction feed gear secured to said feed roller and coaxially therewith about a common drive shaft, the feed gear having a lesser diameter than the diameter of said feed roller;

a mounting means for removably mounting about a printer;

an input media support means attached to the mounting means for supporting a plurality of sheets of media to be printed, the input media support means being vertically oriented, substantially L-shaped and of a width slightly greater than the width of the print media;

pivotable media guide means mounted on the mounting means and including a generally vertically oriented plate having at each outside lateral end a raised portion extending perpendicularly outward from the plane of the guide means, the media guide means resting within the input media support means and adapted for guiding a plurality of sheets of the media;

means for biasing the media guide means away from the input media support;

locking means attached to the mounting means and contacting the media guide means, the locking means being positional and having a first position wherein the media guide means is urged against the input media support and a second position wherein the media guide means is urged by the biasing means away from the input media support;

a first drive shaft and plurality of drive rollers rotatably attached to the mounting means and positioned over the input media support and media guide means wherein when the locking means is in the second position the guide means and the plurality of sheets of media contained therein will be urged against the drive rollers, the first drive shaft including driving means for transferring rotary motion from the friction feed gear to the drive rollers whereby the plurality of individual sheets of media may be driven thereby; and media stripper means, pivotably attached to each outside edge of the media guide means and extending laterally below the media guide means and further including a vertically oriented flag disposed above the lower edge of the guide means near the lateral edges thereof.

2. The feeder of claim 1 and further including media deflector means, disposed about a lower portion of the mounting means, the deflector means including a concave surface aligned with an output of the printer for directing the plurality of media emerging therefrom from a generally vertical orientation to a generally horizontal orientation.

3. The feeder of claim 2 wherein the mounting means includes a first and a second mirror image side plate, secured together by at least one tie bar, the input media support and the media deflector means also being secured therebetween.

4. The feeder of claim 3 wherein the media guide means includes a first and a second mirror image media guide plate, each smaller in width than one-half of a width of a sheet of media to be fed into the printer; and the pivotable media guide includes a mounting bar, secured to each side plate, and each mirror image media guide plate includes a flange perpendicularly formed about a back surface thereof, said flange including an aperture through which said mounting bar may pass.

5. The feeder of claim 4 wherein said first media guide plate includes a releasable securing assembly about said aperture for said mounting bar whereby said first media guide plate may be slidably positioned laterally about said mounting bar.

6. The feeder of claim 4 wherein the means for biasing said media guide means includes a spring intermediate to each media guide plate and the input media support and adapted for urging the media guide plates away from the input media support; and the locking means includes a keeper bar, horizontally positioned between said side plates near the lower ends of said media guide plates, said keeper bar fitting into a slot formed in each side plate, said slot being in the shape of a horizontal "L" such that when said keeper bar is pushed back into the guide plates, said keeper bar may fall into the foot of said "L" slot and thereby lock the media guide plates against the media tray, and when said keeper bar is released from said foot said keeper bar may slide up the slot allowing full extension of the media guide plates.

7. The feeder of claim 6 including a first and a second drive roller, said first roller being positioned over said first media guide plate and said second roller being positioned over said second media guide plate.

8. The feeder of claim 1 wherein the drive means includes a second drive shaft extending horizontally and rotatably secured to the mounting means about a lower portion thereof, said second drive shaft including a first drive gear secured thereto and coaxial therewith and laterally positioned to mesh with said friction feed gear, said second drive shaft further including at a first end thereof a second drive gear secured thereto and coaxial therewith, said second drive gear being located about an outside surface of the mounting means;

a drive roller gear, rotatably mounted about the mounting means and extending slidably around and coaxial with a portion of the first drive shaft extending through the mounting means and through the drive roller gear; and an intermediate gear train, mounted on the mounting means to mesh with the second drive gear and said roller drive gear, whereby said roller drive gear is rotatably driven thereby.

9. The feeder of claim 8 wherein said roller drive gear transfers rotary motion to said first drive shaft through a one way clutch means.

10. The feeder of claim 8 and further including a pin formed onto the roller drive gear and extending perpendicularly above the plane of the roller drive gear;

a key attached to the first drive shaft and extending perpendicularly to an axis of rotation thereof, said key being attached to the first drive shaft at a point where said first drive shaft extends through said roller drive gear, said key being adapted for being contacted by said pin whereby when said pin rotates with said roller drive gear, said key is urged by said pin into concurrent rotation therewith whereby said first drive shaft and said drive rollers are rotatably driven thereby.

11. The feeder of claim 1 wherein the mounting means includes a tapered mounting guide about a lower end thereof, said tapered mounting guide being generally congruent in cross-section to a cross-section of a printer feeding mechanism with which the feeder will operate, said tapered mounting guide including a slot for loosely fitting over a driveshaft of said printer and a notch for securely fitting over a guide rod of said printer, whereby said printer feeder may securely rest atop said printer.

12. The feeder of claim 2 further including an output media tray comprising a planar rigid, slightly flexible and lightweight member and having at one end a means for attaching to the mounting means whereby media emerging from the printer will be deflected by the deflector means onto the output tray.

* * * * *